US006183622B1

(12) United States Patent
Janik

(10) Patent No.: US 6,183,622 B1
(45) Date of Patent: Feb. 6, 2001

(54) DUCTILITY ADDITIVES FOR ELECTROREFINING AND ELECTROWINNING

(75) Inventor: Robert Janik, Plymouth, MI (US)

(73) Assignee: Enthone-OMI, Inc., Warren, MI (US)

( * ) Notice: Under 35 U.S.C. 154(b), the term of this patent shall be extended for 0 days.

(21) Appl. No.: 09/114,820

(22) Filed: Jul. 13, 1998

(51) Int. Cl.[7] ..... C25C 1/12
(52) U.S. Cl. ..... 205/585; 205/67; 205/296
(58) Field of Search ..... 205/67, 70, 76, 205/77, 585, 574, 296

(56) References Cited

U.S. PATENT DOCUMENTS

| | | | | |
|---|---|---|---|---|
| 4,057,554 | | 11/1977 | Redmore et al. | 546/266 |
| 4,336,114 | | 6/1982 | Mayer et al. | 205/298 |
| 4,555,315 | * | 11/1985 | Barbieri et al. | 205/296 |
| 5,733,429 | * | 3/1998 | Martin et al. | 205/77 |

OTHER PUBLICATIONS

Lowerheim, F.A., Electroplating, McGraw–Hill Book Co., New York, pp. 436–437, 1978.*

"ASTM Designation B–490–68: Standard Practice for Micrometer Bend Test for Ductility of Electrodeposits", *Annual Book of ASTM Standards*, vol. 02.05, pp. 316–317, date not available.

* cited by examiner

*Primary Examiner*—Kathryn Gorgos
*Assistant Examiner*—William T. Leader
(74) *Attorney, Agent, or Firm*—Warn IP Law Office

(57) ABSTRACT

A method of electrowinning, electrorefining or electroforming of ductile copper deposits. The method uses an adduct of a tertiary alkyl amine with polyepichlorohydrin in amounts effective for ductilizing a copper deposit form a copper electrolyte.

6 Claims, No Drawings

DUCTILITY ADDITIVES FOR ELECTROREFINING AND ELECTROWINNING

BACKGROUND OF THE INVENTION

The present invention relates to additives for producing ductile and pure copper deposits from electrowinning, electrorefining and electroforming baths. More specifically, the present invention relates to polyepichlorohydrin trimethylamine quarternary additives useful in the electrowinning, electrorefining and electroforming of copper.

Electrowinning and electrorefining are methods of purifying and collecting copper for use in wire circuit boards or the like. In electrowinning, copper is plated directly from solution, using insoluble anodes such as lead. In electrorefining, the copper is plated onto a cathode from a soluble copper anode. These processes are known to those skilled in the art and have been in use since the 1800's.

In electrowinning applications, it has long been desirable to provide electrodeposits which do not require further purification. This has been problematic in two respects. First of all, additives commonly in use tend to oxidize on the insoluble lead anodes when they evolve oxygen. This anode phenomenon also leads to lead oxides which flake off during electrolysis. These unwanted particles will then tend to migrate to the cathodes, causing impurities of lead in the copper deposit. These impurities lead to low ductility in these deposits.

Guar gum has typically been used as a brightening additive for electrowinning. The drawback in using this additive is that it is hard to dissolve into solution and tends to readily break down. This creates erratic electroplating results. In electrorefining, thiourea is often used as an additive. This can result in sulfur co-deposition from the plating residues in the solution. Sulfur then co-deposits as an undesirable impurity in the copper deposit. Therefore, an additive without these disadvantages is desirable.

However, any additive used in electrowinning must also be compatible with solvent extraction of copper from the raw ore and the copper stripping process used in line for replenishing copper to the electrowinning baths. Typically, in order to extract copper from a raw ore, the copper ore is initially dissolved with a sulfuric acid solution. This also leaches many undesirable impurities from the ore. The copper is selectively extracted from the sulfuric acid solution via a solvent-solvent extraction technique. Such techniques are known. In brief, an organic solvent which is not soluble in the aqueous sulfuric acid solution is used. The organic solvent acts to exchange a hydrogen atom to the aqueous solution for a copper atom from the aqueous solution. After this is completed, the organic solvent having the copper ions attached is separated from the aqueous solution, leaving the impurities in the aqueous solution. After separation, the copper must then be stripped from the organic molecule.

Additives, to be useful, must not interfere or hinder this solvent extraction process. Hindrance of solvent extraction can occur in many ways. If an additive is too surface active, it will interfere with the organic water separation, leading to problems. Many organic molecules may interfere with the kinetics of the exchange reaction, reducing the efficiency thereof. Additionally, copper selectivity over iron is somewhat sensitive in the extraction system. Organic additives must not interfere with the selectivity of copper. Additives also must not interfere with the copper stripping process.

Improvements in purity of electrowinned and electroformed copper have been realized, such as by the use of novel polyacrylic acid additives, which are the subject of commonly assigned U.S. Pat. No. 5,733,429, issued Mar. 31, 1998, entitled "Polyacrylic Acid Additives for Copper Electrorefining and Electrowinning".

Ductility has increasingly become important in copper production. With the advent of micro-electronics, wired connections have gotten smaller and smaller. This means that the circuit conductors in microchips have become thinner and thinner. The limits, or the "fineness", of these conductors is directly proportional to the ductility of the copper used. The more the ductility of the copper, the more malleable it is. This allows the copper to be drawn or formed into thinner strands without breaking. As ductility decreases, copper becomes more brittle, hindering fine formation of thin circuit leads. Thus, high ductility copper is very much in demand.

Typically, in order to provide the purity and ductility necessary for such applications, it has been necessary for the electrowinned "rough" copper to be refined further, using various time consuming and expensive processes. Improvement in existing electrowinning and electrorefining baths is, therefore, desirable. Additionally, improvements in the ductility of electroformed copper is desirable, such that thinner gauge wire can be drawn from more ductile copper.

SUMMARY OF THE INVENTION

Therefore, in accordance with the present invention, there is provided a method for electrowinning, electrorefining or electroforming copper from a copper electrolyte. The method includes the steps of providing an electroplating bath, including ionic copper and an effective amount of an additive which is a bath soluble adduct of a tertiary alkyl amine, and electroplating a copper deposit from the bath onto a cathode.

DETAILED DESCRIPTION OF THE PREFERRED EMBODIMENTS

In accordance with the present invention, there is provided a method for electrowinning, electrorefining or electroforming of copper from a standard bath, including new and useful additives therefor. The method, in its broad aspects, includes providing an electrolysis bath, including ionic copper. A bath addition of an effective amount of a bath soluble adduct of a tertiary alkyl amine with an epichlorohydrin is included in the bath of the present invention. A copper deposit is deposited onto a cathode by electroplating with the additive added to the solution.

In the method of the present invention, a preferred ductility additive adduct of a tertiary alkyl amine with an epichlorohydrin has the formula:

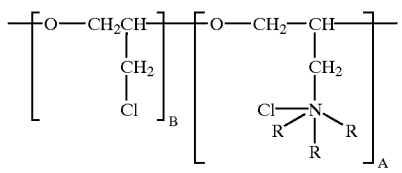

wherein:

R is methyl, ethyl or mixtures of a methyl and ethyl;

A is an integer greater than 0;

B is either 0 or an integer greater than 0;

the sum of A+B is from about 4 to about 500; and $$\frac{A}{A+B} \rightarrow 65\%.$$

In a preferred composition, B is 0 in the above formula. Preferably, the molecular weight of the composition is from about 600 to about 100,000. Further details of process for manufacture of the additives of the subject invention may be found in U.S. Pat. Nos. 3,320,317 and 4,336,114, which are incorporated herein by reference.

The above ductility additive of the present invention is generally effective for providing improved ductility when used in amounts of from about 0.1 mg/l to about 1 gram per liter. Typically, the additives are used in amounts of from about 1–65 mg/l with preferred amounts of from about 6–12 mg/l. Ductility of deposits in accordance with the present invention have been found to be greater than 50%, and preferably greater than 100%, using ASTM B-490-68 as the standard.

The additives of the present invention do not build up in the bath and, therefore, have no detrimental effects in the bath. These additives also do not co-deposit in the copper deposit. Without wishing to be bound by theory, it is believed that the additives break down into carbon dioxide and nitrogen gases which evolve from the solution as such. The additives do not impart sulfur and are compatible with bath chemistry, including the polyacrylic additives discussed above in the "Background of the Invention".

Typically, the copper which is formed from baths of the present invention has improved ductility and purity and may be drawn sufficiently thin for use in computer chip manufacture.

Copper electrolyte baths in which the additives of the present invention are operable are those commercially used for electrowinning, electroforming and electrorefining.

Typically, electrowinning baths of the present invention include sulfuric acid, copper and chlorides in similar amounts as electrorefining baths. However, electrowinning baths typically differ from electrorefining baths in that they may have lower concentrations of copper than that used in electrorefining operations, and they utilize insoluble anodes. Thus, baths in accordance with the present invention are known in the art, and typically are operated in large commercial quantities of from thousands to millions of gallons in size. Typically, electrorefining baths include from about 130 to about 225 grams per liter sulfuric acid, 10 to about 75 grams per liter chloride ions, and typically from about 30 to about 60 grams per liter copper ion concentration. In electrowinning baths, copper is found in amounts of generally from about 10 to about 70 grams per liter, and typically from about 25 to about 50 grams per liter of copper ions. Because the baths are typically obtained from raw copper ores or semi-refined copper ores, the baths contain impurities found in such ores. These impurities may include cobalt or nickel ions, antimony ions, bismuth ions, arsenic ions, ferrous sulfate, tellurium ions, manganese ions, molybdenum ions, selenium ions, gold ions, silver ions, etc. Other impurities may be found in these baths, depending on the sources of the ore and additives which have been used in the bath in the past. Amounts of these and other impurities may vary substantially, depending on the source of the ore.

The ductility additives are set forth herein in their additive form, when added to the bath, it is to be appreciated by those skilled in the art, that these additives may disassociate and may be in different forms in the bath themselves.

Additives of the present invention are compatible with copper solvent extraction processes, since they do not have any surfactant properties which detrimentally affect the process. Additives of the present invention do not harmfully interfere with normal copper iron selection and do not adversely affect normal reaction kinetics. Additives of the present invention also do not harmfully interfere with copper stripping operations.

Additionally, the additives of the present invention are useful in the process of electrowinning of wire directly from an electrowinning bath. Such a process is set forth in U.S. Pat. No. 5,242,571, entitled "Method and Apparatus for the Electrolytic Production of Copper Wire", issued Sep. 7, 1993 to Sein et al, which patent is incorporated herein by reference thereto. The additives of the present invention, when used in electrowinning of wire, are used in accordance with the guidelines set forth above. Additives of the present invention produce highly ductile fine-grained copper wire. Because of the ductility improvements provided by the additives of the present invention, electrolytic formation of wire requires less work during the drawing process. Also, the wire formed by such processes may be drawn into thinner strands because of increased ductility. This provides a great improvement over prior processes for electrowinning of wire.

A further understanding of the present invention will be had by reference to the following examples which are set forth herein, for purposes of illustration but not limitation.

EXAMPLE I

An electrorefining electrolyte is analyzed and has the constituents set forth in Table I below.

TABLE I

Copper Electrorefining Electrolyte

| Constituent | Amount |
|---|---|
| Copper Sulfate | 180 g/l |
| Sulfuric Acid | 150 g/l |
| Chloride Ion | 30 mg/l |
| Nickel Ion | 15 mg/l |
| Arsenic Ion | 6 g/l |
| Ferrous Ion | 9 g/l |
| Tellurium Ion | 150 g/l |
| All Other Impurities | <400 mg/l |

To the bath is added 11 mg/l of polyepichlorohydrin trimethylamine quarternary, having a molecular weight of 2,000 and the formula:

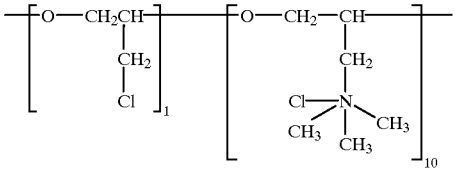

The bath is operated at 150° F., at 20 amps per square foot cathode current density. The deposit is ductile and fine-grained with no dendrites.

EXAMPLE II

A copper electrowinning solution is analyzed to contain the constituents set forth in Table II.

TABLE II

| Copper Electrowinning Electrolyte | |
|---|---|
| Constituent | Amount |
| Copper Sulfate | 170 g/l |
| Sulfuric Acid | 165 g/l |
| Chloride Ion | 30 mg/l |
| Nickel | 7.5 mg/l |
| Iron | 9 g/l |
| Arsenic | 10 g/l |
| All Other Impurities | <500 mg/l |

11 mg/l polyepichlorohydrin trimethylamine quarternary is added to the bath. This constituent has the formula:

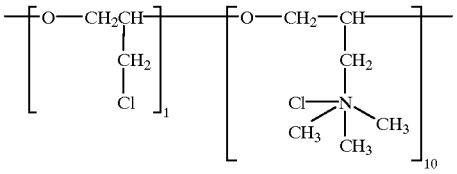

where A is about 10 and B is about 1, the compound having a molecular weight of about 2900. The bath is operated at a temperature of 140° F., with cathode current densities of 12 amps per square foot. The resulting electrowinned copper is found to be pure, highly-ductile and fine-grained.

EXAMPLE III (Control)

Samples of electrowinning electrolytes were removed from a commercial electrowinning production facility, which has substantially the same chemistry as that set forth in Example I but includes glue, thiourea and avitone, and placed in one liter beakers as a comparative test. This sample is then placed in a suitable electroplating cell and heated to 150° F. A copper is plated onto a passivated stainless steel substrate until a plating thickness of about 4 mils. The foil is cracked and brittle.

EXAMPLE IV

To a second sample of the solution obtained from Example III, 12 mg/l of polyepichlorohydrin trimethylamine quarternary was added. The solution was placed in a suitable electroplating cell. At a temperature of 150° C., two foil samples are created, one about 1.2 mils and the other about 3.0 mils. The deposit was found to be extremely ductile with no cracking or brittleness.

EXAMPLE V (Ductility)

Utilizing the method of ASTM B-490-68, ductility of the deposits is determined. A 1" by ¼" strap of the copper foil is secured and measured in a suitable micrometer. Following the above ASTM procedure, the strip is bent in a "U" shape and placed in the jaws of the micrometer. The jaws are closed until cracking occurs, and the measurement is read off the micrometer. This measurement is recorded as R. The value of ductility is measured by the formula: plate thickness/2R=ductility.

Samples of electroplate from the bath of Example III and Example IV were obtained and measured in accordance with ASTM B-490-68. In the plate of the control Example IIII, this value was 0.205 (or 20.5%). In the electroplate of Example IV above, (copper plate using the additive of the present invention), there was no cracking during the micrometer testing described above. Thus, using the ASTM test above, ductility would be over 100%. The deposits were very ductile with the use of the additive of the present invention.

EXAMPLE VI

One liter samples of a commercial electrowinning bath are collected. To each of these samples is added adducts of tertiary alkyl amines selected from the formula in the table below:

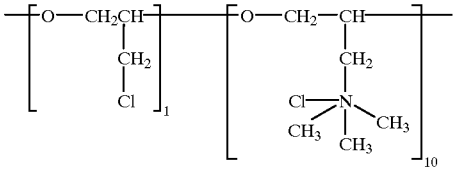

TABLE III

| R | A | B | A + B | Amounts |
|---|---|---|---|---|
| methyl | 10 | 0 | 10 | 0.1 mg/l; 1 mg/l; 6 mg/l; 12 mg/l; 65 mg/l; 1 g/l |
| ethyl | 10 | 0 | 10 | 0.1 mg/l; 1 mg/l; 6 mg/l; 12 mg/l; 65 mg/l; 1 g/l |
| methyl | 10 | 1 | 10 | 0.1 mg/l; 1 mg/l; 6 mg/l; 12 mg/l; 65 mg/l; 1 g/l |
| ethyl | 10 | 1 | 10 | 0.1 mg/l; 1 mg/l; 6 mg/l; 12 mg/l; 65 mg/l; 1 g/l |
| methyl | 3 | 1 | 4 | 0.1 mg/l; 1 mg/l; 6 mg/l; 12 mg/l; 65 mg/l; 1 g/l |
| ethyl | 3 | 1 | 4 | 0.1 mg/l; 1 mg/l; 6 mg/l; 12 mg/l; 65 mg/l; 1 g/l |
| methyl | 90 | 10 | 100 | 0.1 mg/l; 1 mg/l; 6 mg/l; 12 mg/l; 65 mg/l; 1 g/l |
| ethyl | 90 | 10 | 100 | 0.1 mg/l; 1 mg/l; 6 mg/l; 12 mg/l; 65 mg/l; 1 g/l |
| methyl | 180 | 20 | 200 | 0.1 mg/l; 1 mg/l; 6 mg/l; 12 mg/l; 65 mg/l; 1 g/l |
| ethyl | 180 | 20 | 200 | 0.1 mg/l; 1 mg/l; 6 mg/l; 12 mg/l; 65 mg/l; 1 g/l |
| methyl | 450 | 50 | 500 | 0.1 mg/l; 1 mg/l; 6 mg/l; 12 mg/l; 65 mg/l; 1 g/l |
| ethyl | 450 | 50 | 500 | 0.1 mg/l; 1 mg/l; 6 mg/l; 12 mg/l; 65 mg/l; 1 g/l |

The electrowinning baths are operated at 140° F. at 12 ASF. Each of the baths containing the above additives are found to produce extremely ductile electrowinning deposits.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. A method for improving the ductility of copper produced by the electrowinning or electrorefining of copper from a copper electrolyte bath comprising:

providing a copper electrolysis bath including ionic copper and adding an addition agent consisting essentially of a bath soluble adduct of a tertiary alkyl amine having the formula

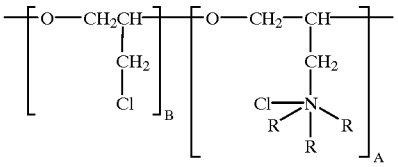

wherein:

R is methyl, ethyl or mixtures of a methyl and ethyl;

A is an integer greater than 0;

B is either 0 or an integer greater than 0;

the sum of A+B is from about 4 to about 500; and $$\frac{A}{A+B} \geq 65\%.$$

in an amount sufficient to increase the ductility of the produced copper, and electroplating a copper deposit from said bath onto a cathode.

2. The method of claim 1 wherein the addition agent has a molecular weight of from about 600 to about 100,000.

3. The method of claim 1 wherein the adduct of tertiary alkyl amine with polyepichlorohydrin is present in the bath in an amount of from about 0.1 mg/l to about 1 gram per liter.

4. The method of claim 1 wherein the adduct of tertiary alkyl amine with polyepichlorohydrin is present in the bath in an amount of from about 1.0 mg/l to about 65 mg/l.

5. The method of claim 1 wherein the adduct of tertiary alkyl amine with polyepichlorohydrin is present in the bath in an amount of from about 6 mg/l to about 12 mg/l.

6. The method of claim 1 wherein B is 0.

* * * * *